US011111062B2

(12) United States Patent
Herlin et al.

(10) Patent No.: US 11,111,062 B2
(45) Date of Patent: Sep. 7, 2021

(54) METHOD OF MAKING PACKAGING CONTAINER FOR BULK SOLIDS

(71) Applicant: AR Packaging Systems AB, Lund (SE)

(72) Inventors: Henrik Herlin, Kristianstad (SE); Simon Holka, Staffanstorp (SE); Eva Sunning, Annelöv (SE)

(73) Assignee: AR Packaging Systems AB

( * ) Notice: Subject to any disclaimer, the term of this patent is extended or adjusted under 35 U.S.C. 154(b) by 192 days.

(21) Appl. No.: 16/278,979

(22) Filed: Feb. 19, 2019

(65) Prior Publication Data

US 2019/0177055 A1 Jun. 13, 2019

Related U.S. Application Data

(63) Continuation of application No. 15/523,810, filed as application No. PCT/SE2015/051153 on Nov. 2, 2015, now abandoned.

(30) Foreign Application Priority Data

Nov. 3, 2014 (SE) ..... 1451309-7

(51) Int. Cl.
*B65D 51/20* (2006.01)
*B65D 25/08* (2006.01)
(Continued)

(52) U.S. Cl.
CPC ..... *B65D 51/20* (2013.01); *A24F 23/00* (2013.01); *B65D 3/24* (2013.01); *B65D 21/0217* (2013.01);
(Continued)

(58) Field of Classification Search
CPC ..... B65D 51/20; B65D 47/0838; B65D 21/0217; B65D 43/16; B65D 85/70;
(Continued)

(56) References Cited

U.S. PATENT DOCUMENTS 2,073,636 A 3/1937 Holoubek
2,317,651 A 4/1943 Talbot
(Continued)

FOREIGN PATENT DOCUMENTS

CN 201338810 Y 11/2009
CN 101754912 A 6/2010
(Continued)

OTHER PUBLICATIONS

International Search Report for Application No. PCT/SE2015/051153 dated Feb. 8, 2016.
(Continued)

*Primary Examiner* — Ryan J. Walters
(74) *Attorney, Agent, or Firm* — Lerner, David, Littenberg, Krumholz & Mentlik, LLP

(57) ABSTRACT

The present invention provides a packaging container for bulk solids. The container comprises a container body having a container wall extending from a container bottom to a container opening in a height direction of the container. The container wall and the container bottom delimit an inner space in the container, and a first peelable or tearable sealing membrane being attached to an inner surface of the container wall forms a roof over a first inner compartment in the inner space. A second peelable or tearable sealing membrane is applied between the first peelable or tearable sealing membrane and an edge of the container opening and is attached to the inner surface of the container wall. The first peelable or tearable sealing membrane forms a floor of a second inner compartment in the inner space and the second peelable or tearable sealing membrane forms a roof over the second inner compartment.

20 Claims, 4 Drawing Sheets

(51) Int. Cl.

| | |
|---|---|
| ***B65D 3/24*** | (2006.01) |
| ***B65D 51/24*** | (2006.01) |
| ***B65D 47/08*** | (2006.01) |
| ***A24F 23/00*** | (2006.01) |
| ***B65D 21/02*** | (2006.01) |
| ***B65D 43/16*** | (2006.01) |
| ***B65D 85/00*** | (2006.01) |

(52) U.S. Cl.
CPC ..... *B65D 25/08* (2013.01); *B65D 43/16* (2013.01); *B65D 47/0838* (2013.01); *B65D 51/247* (2013.01); *B65D 85/70* (2013.01); *B65D 2251/009* (2013.01); *B65D 2251/0021* (2013.01); *B65D 2251/0025* (2013.01); *B65D 2251/0028* (2013.01); *B65D 2251/0093* (2013.01); *Y10T 29/49826* (2015.01)

(58) Field of Classification Search
CPC ..... B65D 25/08; B65D 3/24; B65D 51/247; B65D 2251/0025; B65D 2251/0021; B65D 2251/0028; B65D 2251/009; B65D 2251/0093; B65D 5/0272; B65D 5/48024; B65D 5/603; A24F 23/00; Y10T 29/49826
See application file for complete search history.

(56) References Cited

U.S. PATENT DOCUMENTS

| | | | | |
|---|---|---|---|---|
| 2,324,670 | A | 7/1943 | Bergen | |
| 2,371,173 | A | 3/1945 | Hothersall | |
| 2,569,851 | A | 10/1951 | Farrell | |
| 2,948,454 | A | 8/1960 | Gillmore | |
| 3,042,288 | A | 7/1962 | Carpenter, Sr. | |
| 4,078,686 | A | 3/1978 | Karesh | |
| 4,804,101 | A | 2/1989 | Heath | |
| 5,514,394 | A | 5/1996 | Lenahan | |
| 5,803,294 | A | 9/1998 | Bello et al. | |
| 6,092,717 | A | 7/2000 | Lowry | |
| 6,415,940 | B1 | 7/2002 | Brabson, II | |
| 6,450,351 | B1 | 9/2002 | Thompson | |
| 6,761,279 | B1 | 7/2004 | Martin et al. | |
| 7,370,788 | B1 | 5/2008 | Otani et al. | |
| 7,798,319 | B1 * | 9/2010 | Bried | B65D 51/16 206/242 |
| 8,025,171 | B2 * | 9/2011 | Cassol | B65D 17/4012 220/270 |
| 8,915,395 | B2 | 12/2014 | Gersovitz | |
| 2002/0130126 | A1 | 9/2002 | Rosenberg | |
| 2004/0238553 | A1 | 12/2004 | Lane et al. | |
| 2005/0173501 | A1 | 8/2005 | Jones | |
| 2006/0257534 | A1 | 11/2006 | Maddock | |
| 2008/0041861 | A1 | 2/2008 | Crawford et al. | |
| 2008/0156805 | A1 | 7/2008 | Perry et al. | |
| 2008/0156808 | A1 | 7/2008 | Perry et al. | |
| 2009/0039078 | A1 | 2/2009 | Sanfilippo et al. | |
| 2009/0177179 | A1 | 7/2009 | Engelbrecht | |
| 2009/0236346 | A1 | 9/2009 | Hofeldt et al. | |
| 2009/0314775 | A1 | 12/2009 | Dietrich et al. | |
| 2010/0018883 | A1 | 1/2010 | Patel | |
| 2010/0065557 | A1 | 3/2010 | Gersovitz | |
| 2010/0108670 | A1 | 5/2010 | Perry et al. | |
| 2010/0133127 | A1 | 6/2010 | Jenner | |
| 2010/0142862 | A1 | 6/2010 | Sam | |
| 2010/0180553 | A1 | 7/2010 | Tilton | |
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2011/0006066 | A1 | 1/2011 | Vandamme et al. | |
| 2011/0253725 | A1 | 10/2011 | Killian | |
| 2012/0103353 | A1 | 5/2012 | Sebastian et al. | |
| 2017/0073142 | A1 | 3/2017 | Loomis et al. | |
| 2017/0297769 | A1 | 10/2017 | Gersovitz | |

FOREIGN PATENT DOCUMENTS

| | | | |
|---|---|---|---|
| DE | 884862 | C | 7/1953 |
| EP | 2716551 | A1 | 4/2014 |
| GB | 819960 | A | 9/1959 |
| GB | 2281895 | A | 3/1995 |
| JP | H0558640 | U | 8/1993 |

OTHER PUBLICATIONS

Extended European Search Report including Search Opinion for Application No. EP15857700 dated Jul. 25, 2018, 7 pages.
Chinese Search Report for Application No. 2015800700798 dated Jul. 31, 2018, 2 pages.
Swedish Office Action for SE Application No. 1451309-7, dated Dec. 18, 2018.

* cited by examiner

METHOD OF MAKING PACKAGING CONTAINER FOR BULK SOLIDS

CROSS-REFERENCE TO RELATED APPLICATIONS

This application is a continuation of U.S. application Ser. No. 15/523,810, filed May 2, 2017, which is a national phase entry under 35 U.S.C. § 371 of International Application No. PCT/SE2015/051153, filed Nov. 2, 2015, which claims priority from SE Application No. 1451309-7, filed Nov. 3, 2014, all of which are incorporated herein by reference.

TECHNICAL FIELD

The present invention relates to a packaging container for bulk solids, the container comprising a container body having a container wall extending from a container bottom to a container opening in a height direction of the container, the container wall and the container bottom forming walls of a first inner compartment in the container, and a first peelable or tearable sealing membrane being attached to an inner surface of the container wall and forming a roof over the first inner compartment.

BACKGROUND

Consumer goods, in particular bulk solids, are often packaged in relatively rigid packaging containers which protect the bulk solids during transport and storage at the manufacturer and retailer end and during storage and dispensing at the consumer end. One of the important factors in the area of bulk packaging containers is to ascertain that the quality of the packaged goods remains at a high level from the initial opening of the container until the packaged product has been completely consumed.

In U.S. Pat. No. 2,317,651 it has been suggested to provide a rectangular packaging carton for packaging cereals, breakfast food, coffee, tea or tobacco with multiple inner compartments separated by tray-like closure members which are heat-sealed or adhesively attached to the inner walls of the packaging container. The closure members are arranged to provide improved protection for non-used quantities of the packaged goods. In order to access the contents in a compartment, the closure member immediately overlaying the compartment is punctured or removed, whereafter the packaged contents may be taken out of the exposed compartment. The container in U.S. Pat. No. 2,317,651 is closed at the bottom and top ends by folding in and securing closing flaps which are formed as extensions of the container side walls. Although the division of the interior of the container into multiple compartments to some extent improves the shelf-life of the packaged goods, there is still room for improvement.

Hence, there remains a need for a reliable and hygienic packaging container for consumer gods in the form of bulk solids, which container provides improved protection of the bulk solids during transport, storage and dispensing.

SUMMARY

An object of the invention as disclosed herein is to provide a packaging container which provides protection of packaged bulk solids over a prolonged time period.

As set out herein, there is offered a packaging container for bulk solids in accordance with claim 1.

Further embodiments are set out in the dependent claims.

A packaging container for bulk solids according to the present invention comprises a container body having a container wall extending from a container bottom to a container opening in a height direction of the container, the container wall having wall portions and corner portions. The container wall and the container bottom delimit an inner space in the container, and a first sealing membrane which is attached to an inner surface of the container wall forms a roof over a first inner compartment in the inner space. A second sealing membrane is applied between the first sealing membrane and an edge of the container opening and is attached to the inner surface of the container wall. The first sealing membrane forms a floor of a second inner compartment in the inner space, while the second membrane forms a roof over the second inner compartment.

The first sealing membrane and the second sealing membrane are peelable or tearable sealing membranes, the corner portions are curved corner portions, and a rim is applied to the edge of the container opening and is affixed to the container body along the edge of the container opening and an openable and closable lid is arranged to engage with the rim to form a closure on the packaging container, At least one of the first and second inner compartments is arranged to contain pulverulent bulk solids. Accordingly, at least one of the sealing membranes forms a protective cover over pulverulent bulk solids contained in an inner compartment of the packaging container.

A height direction of a packaging container as disclosed herein is the vertical direction of the packaging container when standing with its bottom placed on a horizontal surface. A transverse direction of the packaging container is perpendicular to the height direction and corresponds to the horizontal direction of the packaging container when standing with its bottom placed on a horizontal surface.

The peelable or tearable sealing membranes in the container may be arranged perpendicular to the height direction of the packaging container and form horizontal partitions between the inner compartments in the packaging container. It is alternatively conceivable to arrange at least one peelable or tearable sealing membrane at an angle to the horizontal direction, whereby the sealing membrane forms a slanted partition inside the packaging container.

The bulk solids as disclosed herein may be pulverulent consumer goods, including alimentary or consumable products such as infant formula, tea, coffee, cocoa, sugar, flour, tobacco, etc., as well as house-hold chemicals such as detergents and dishwasher powder. The pulverulent products which are suitable for packaging in the packaging containers as disclosed herein are flowable, which means that a desired amount of the product may be poured or scooped out of the packaging container.

By a pulverulent material as used herein is implied any material in the form of particles, granules, grinds, plant fragments, etc.

By a "peelable or tearable sealing membrane" is meant a membrane that may be cleanly removed by a user in order to provide access to an inner compartment of the packaging unit either by breaking a joint between the sealing membrane and the inner surface of the container wall, or by breaking the sealing membrane itself along a pre-formed tear indication. A peelable sealing membrane can be completely removed from the packaging container by breaking the seal between the inner surface of the container wall and "peeling" away the sealing membrane from the wall. A tearable sealing membrane is a membrane which is provided with a tear indication which promotes controlled tearing of the sealing membrane along the tear indication. By the provision of a tear indication, such as a partial scoring through the thickness of the membrane material, it may be ascertained that no torn-off fragments of the sealing membrane falls down into the contents of the compartment which is revealed beneath the sealing membrane. Preferably, the tear indication is arranged close to the inner surface of the container wall such that the sealing membrane may be torn away leaving no residual membrane edge or only a narrow residual membrane edge protruding into the inner space of the container and restricting access to the contents in the revealed compartment. Accordingly, the residual membrane edge is preferably less than 10 mm wide, more preferably less than 5 mm wide and most preferably less than 2 mm wide.

In a packaging container as disclosed herein it may be preferred that each of the sealing membranes comprises a gripping member. The gripping member may be a gripping tab which is formed integrally with the sealing membrane or may be a separate component such as a gripping tab, a gripping ring or similar which is permanently attached to the sealing membrane. The provision of a gripping member on a sealing membrane makes it easier for a user to remove the sealing membrane by simply pulling the sealing membrane away by means of the gripping member. A gripping member is useful on peelable sealing membranes and tearable sealing membranes alike and may be particularly useful when wishing to conveniently remove a sealing membrane which is positioned deep down in the packaging container where it may be difficult to reach with an opening tool. The gripping member further improves hygienic opening of a packaging compartment as the risk of contaminating the packaged goods by contact with a user's hand or an opening tool is eliminated.

The first peelable or tearable sealing membrane may be gastight or gas-permeable. A gastight membrane may be manufactured from any material suitable for providing a gastight sealing of a compartment delimited by the sealing membrane, such as aluminium foil, silicon-coated paper, plastic film, or laminates thereof. Laminates of aluminium foil and polythene film may be particularly useful and may have a combined thickness of from 50 μm to 150 μm. A gastight membrane may be particularly advantageous when the bulk solids stored in the packaging container are sensitive to air and/or moisture, and it is desirable to avoid contact of the bulk solids with the ambient air as long as possible. Likewise, the joints between the peelable or tearable sealing membranes and the inner container wall may be gastight or gas permeable. Preferably, a gastight membrane is joined to the inner wall of the packaging container by means of a gastight seal. A joint between the inner container wall and a peelable or tearable sealing membrane may be formed in any suitable manner as known in the art, such as by gluing or welding.

The curved corner portions of the container wall allows a sealing membrane to be pushed into the container and to be fitted to the inner surface of the container wall without any preshaping or pre-folding of the sealing membrane at the corner portions. This is advantageous when wishing to produce a tight seal between the sealing membrane and the container wall as the risk of gaps being formed between the sealing membrane and the container wall at the corner portions is considerably reduced or even eliminated as compared to sealing membranes having folded corner portions.

Analogous to the above, the second sealing membrane may be gastight or gas-permeable. The material of the first and the second sealing membrane may be the same or different.

The height of the first inner compartment, i.e. the distance $d_1$ between the container bottom and the first sealing membrane in the height direction may be selected depending on the desired size of the first inner compartment. The number of additional compartments in the packaging container and the type of goods packaged in the compartment may also influence the size of the distance $d_1$. By way of example, in a packaging container having only two sealed inner compartments, the distance $d_1$ between the container bottom and the first sealing membrane in the height direction may be from 30% to 70% of the distance D between the container bottom and the container opening in the height direction, i.e. of the height of the container body.

Further, the height of the second inner compartment, i.e. the distance $d_2$ between the first sealing membrane and the second sealing membrane in the height direction may be selected depending on the desired size of the second inner compartment. Analogous to the distance $d_1$, the number of additional compartments in the packaging container and the type of goods packaged in the compartment may also influence the size of the distance $d_2$. It may be desired that the second sealing membrane or any uppermost sealing membrane is placed at a distance from the container opening, such that a further compartment is formed above the uppermost sealing membrane, between the container lid and the uppermost sealing membrane. In such case, the total height $d_1+d_2 \ldots d_n$ of the sealed inner compartments may be somewhat less that the total height D of the container body, and may be in the order of 75% to 95% of the height D of the container body. A compartment formed between the lid and the uppermost sealing membrane may be used to contain an auxiliary device, such as a scoop or other implement, a separately packaged ingredient, etc.

The distance $d_1$ may be equal to or different from the distance $d_2$.

Thus, the packaging container according to the present invention keeps the bulk solids arranged and sealed in different inner compartments which are separated from each other by means of the sealing membranes. Therefore, the packaging container has the advantage of providing a prolonged preserving of the bulk solids stored therein. This advantage arises from the fact that the user accesses one inner compartment at a time, e.g. starting from the compartment adjacent to the container opening, while the inner compartments below the opened compartment remain sealed, thus keeping the contents of these compartments protected from contamination and from other effects of contact with ambient air and moisture. Further, accessing one inner compartment at a time has the advantage of keeping the contents of the still sealed inner compartments from falling out of the container should the user accidentally drop the container, or when the user needs to transport the container being in use. Furthermore, when a gastight sealing membrane is used, the quality of air and/or moisture sensitive bulk solids contained in the still sealed inner compartments may be preserved for a longer period of time. In this manner, larger packaging containers may be used with the end effect of making it possible to reduce the amount of packaging material needed. The possibility to reduce the amount of packaging material is beneficial both from an environmental point of view and for economic reasons, as less packaging material has to be produced, transported and stored.

The size of the inner compartments of the container according to the present invention may be adapted to contain a quantity of a bulk solid needed for one use at a single occasion. For instance, each of the inner compartments may contain a quantity of an infant formula powder needed to prepare one serving. Thus, the need for an additional measuring device is eliminated, and the contents in the still sealed compartments are kept away from contact with the ambient air.

The packaging container may comprise three or more sealing membranes, thus forming three or more inner compartments, such as 3-10 inner compartments. The inner compartments being in addition to the first inner compartment are delimited in the height direction of the container by peelable or tearable sealing membranes as disclosed herein.

As discussed above, the size of the inner compartments in the packaging container may be the same or different.

The uppermost peelable or tearable sealing membrane that is located closest to the container opening forms a roof over a corresponding uppermost inner compartment being located closest to the container opening and may form a partition between the uppermost inner compartment and a space located between the uppermost peelable or tearable sealing membrane and a container lid.

The contents of each of the inner compartments may be same or different. Thus, each of the inner compartments may contain a quantity of the same pulverulent bulk solid. Alternatively, at least one inner compartment may contain a bulk solid which is different from a bulk solid in another of the inner compartments. Moreover, one or more of the inner compartments may contain an item rather than the bulk solid, such as an auxiliary device to be used together with the bulk solid stored in the packaging container, as will be discussed below. It is not recommended to mix alimentary and non-alimentary bulk solids within the same packaging container in order to avoid contamination of the alimentary bulk solids with non-alimentary bulk solids.

The container body of the packaging container according to the present invention may have a cuboid or generally cuboid shape. As used herein, the term "cuboid" refers to a polyhedron having rectangular or generally rectangular faces. The cuboid may have rounded or bevelled edges. Although details of a cuboid packaging such as a lid, a rim, corner portions, locking members, etc. may cause the shape of the packaging container to deviate from a perfect rectangular cuboid, the overall impression of the container shape is that of a rectangular cuboid.

The packaging container may be a paperboard container wherein the container body may be formed from paperboard sheet material.

As used herein, the term "paperboard packaging container" means a container wherein at least the container body is formed from paperboard sheet material.

By a paperboard material as used herein is implied a sheet material which is predominantly made from paper fibers. The paperboard material may be a single ply or multi ply material and may be a laminate comprising one or more layers of other materials such as polymeric materials, metal, etc. The paperboard material may be coated, printed, embossed, etc. and may comprise fillers, pigments, and other additives as known in the art. The paperboard materials as disclosed herein may also be referred to as cardboard or carton materials.

A paperboard container may be formed in any manner known in the art, e.g. by bending a paperboard sheet material into a tubular shape and sealing overlapping or abutting side edges of the sheet material. A sealing strip may be attached over the join between the side edges of the container body tube. The container bottom may be formed from a separate bottom plate which is attached at one end of the container body tube or may be formed by folding an end portion of the container body tube.

The container wall of the packaging container may comprise a front wall portion, a rear wall portion and two side wall portions, wherein the wall portions are connected at container body edge portions.

The curved corner portions of the packaging container may have a radius of curvature of from 15-100 mm. The curved corner portions provide the packaging container with improved stability and crush resistance. A container comprising multiple storage compartments may be considered to be suitable for storing a larger total quantity of packaged goods than a container having only a single storage compartment as the multiple compartment packaging container may keep the packaged goods fresh for a longer period of time. As a multiple compartment packaging container may be expected to have an extended service life it would also need to withstand handling during a longer time period than a single compartment container.

The rim which is applied to the edge of the container opening may be a rim of plastic, paper or metal with plastic rims being preferred. The rim preferably extends around the full periphery of the container opening and may be affixed to the container body along the opening edge by any suitable method or combination of fastening methods such as by adhesive or welding.

A rigid plastic upper reinforcing rim as disclosed herein which is attached at the edge of the container opening contributes to shape and stabilize the flexible paperboard container body opening edge and thereby ascertains that the container body wall is provided with a desired shape and in particular that the curved corner portions are provided with a predetermined and stable curvature. In a corresponding manner, the packaging container as disclosed herein may be provided with a bottom rim, the bottom rim further contributing to shape and stabilize the container body bottom edge and the container body wall.

The container lid is arranged to engage with the rim to form a closure on the container. The closure between the container lid and the rim is preferably liquid tight and may also be gas tight or at least substantially gas tight to provide good protection of the contents in an opened compartment inside the container. A tight closure between the container lid and the rim may be accomplished by mating contours on the lid and on the plastic rim and may include snap-lock features such as interengaging ridges and tracks, protrusions and holes/cavities, etc. Further, a sealing material, such as a coating or a pad or a strip of rubber or silicone, may be arranged along the periphery of the rim or on the lid.

The closure between the container lid and the container body may comprise or be provided by a locking arrangement comprising a first locking element arranged on the container body or on a rim at the container opening and a second locking element arranged on the container lid. The first and second locking elements may be mating locking elements, such as female/male locking elements including hooks and other protrusions which are arranged to interengage with ridges, hooks, tracks, holes, cavities, loops, etc. By way of example, a locking arrangement may be provided by a locking flap or clasp closure extending from the front edge on the lid and comprising at least one locking element which can be fastened into or onto a corresponding locking element on the container body or on a plastic rim attached at the container opening. The locking elements are preferably designed to allow repeated opening and closing of the locking arrangement. Manipulation of the locking arrangement may be facilitated by means of gripping devices such as finger grips, friction enhancing elements, etc.

The container lid may be provided as a separate component which can be completely removed when opening the container. Alternatively, the container lid may be attached by a hinge which may be arranged directly on the container body or be indirectly joined to the container body by means of a rim which has been applied to the opening edge of the container body. The hinge may be a live hinge, i.e. a bendable connection between the lid and the container body or rim. A live hinge may be formed integral with the lid and/or a plastic rim or upper edge portion of a container body or may be a separately formed element which it attached to the container lid and to the container body or to the container lid and to a rim. Alternatively, the hinge may be a two-part hinge, with a first hinge part arranged on the container lid and a second hinge part arranged on the container body or on an opening edge rim.

The packaging container may further comprise an openable and closable lid arranged to cover the container bottom. Thus, the container may be accessed from both the container opening and the container bottom. This may be advantageous when the packaging container contains two different kinds of bulk solids that may be used either independently, such as coffee and tea, or in combination with each other, such as coffee and sugar. In such an embodiment, the bulk solid of the first kind may be positioned in the inner compartment adjacent to the container opening, and the bulk solid of the second kind may be positioned in the inner compartment adjacent to the container bottom. The user may thus choose whether to access the opening at the container top or the opening at the container bottom, depending on the desirable bulk solid.

In a packaging container having lids at both ends, a non-removable inner sealing membrane may be arranged between two peelable or tearable sealing membranes.

The compartments at the ends of the container will then be separated by a non-removable inner sealing membrane such that one or more of the compartments in the packaging container can be accessed only from the opening end which is located on one side of the non-removable inner sealing membrane and one or more of the compartments in the packaging container can be accessed only from the opening end which is located on the other side of the non-removable inner sealing membrane.

When the uppermost sealing membrane as disclosed herein is arranged at a distance from the container opening, an additional inner compartment will be formed between the lid on the container opening and the uppermost sealing membrane. Thus, the floor of such an additional inner compartment will be formed by the uppermost sealing membrane, while the roof of the additional inner compartment will be formed by the lid. Such an additional compartment may be used for containing an auxiliary device to be used with the bulk solids stored in the container, such as a measuring device, a hygrometer, an information booklet, cigarette paper, or the like. In the embodiments wherein a lid is provided both at the container top and the container bottom, an additional inner compartment may be provided both at the container top and the container bottom. Each of these additional inner compartments may comprise the same or different auxiliary devices.

The packaging container may comprise print and/or a relief pattern in order to provide logos, brand names, informative illustrations or eye-catching pictures. The print and/or relief pattern may be arranged on the outer or the inner surface of the packaging container, on the lid, or on one or several of the sealing membranes, or any combinations thereof.

The packaging container as disclosed herein may comprise mating stacking members for allowing two or more of the packaging containers to be arranged in a stacked configuration. The mating stacking members are arranged at the container bottom and at the container opening. A stacking member or stacking members at the container opening may be arranged on the container lid and/or on an upper plastic rim surrounding the opening in the packaging container. The container lids may be provided with mating stacking members arranged on the upper outer surface and on the inner lower surface of each lid, making the lids separately stackable before being applied to a packaging container, e.g. in a process for producing the packaging containers as disclosed herein.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of material are not necessarily drawn to scale. The packaging containers shown in the figures are provided as examples only and should not be considered limiting to the invention. Accordingly, the scope of the invention is determined solely by the appended claims.

Figure 2:
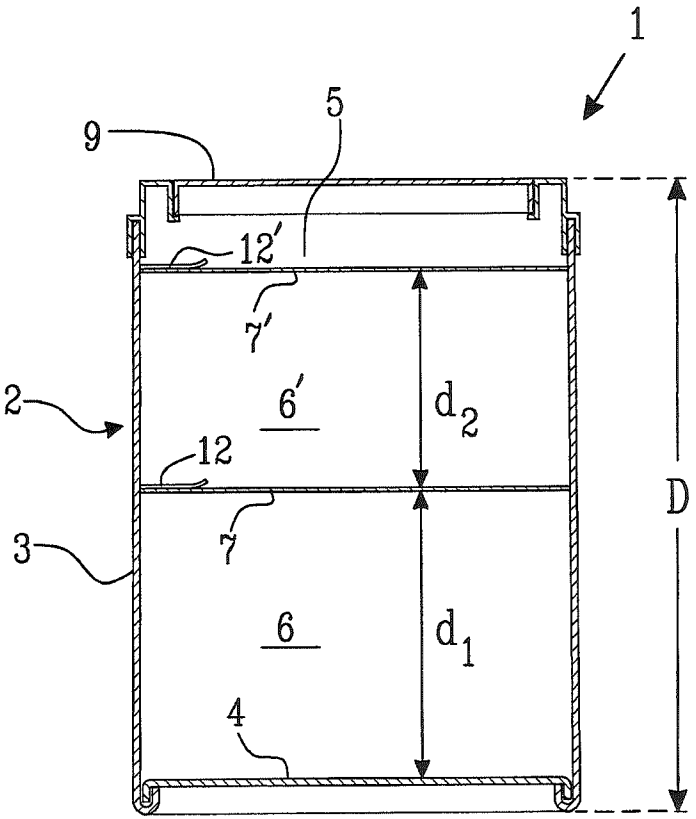
FIG. 2 shows the cross-section of the packaging container in the height direction along plane II-II.
Figure 1:
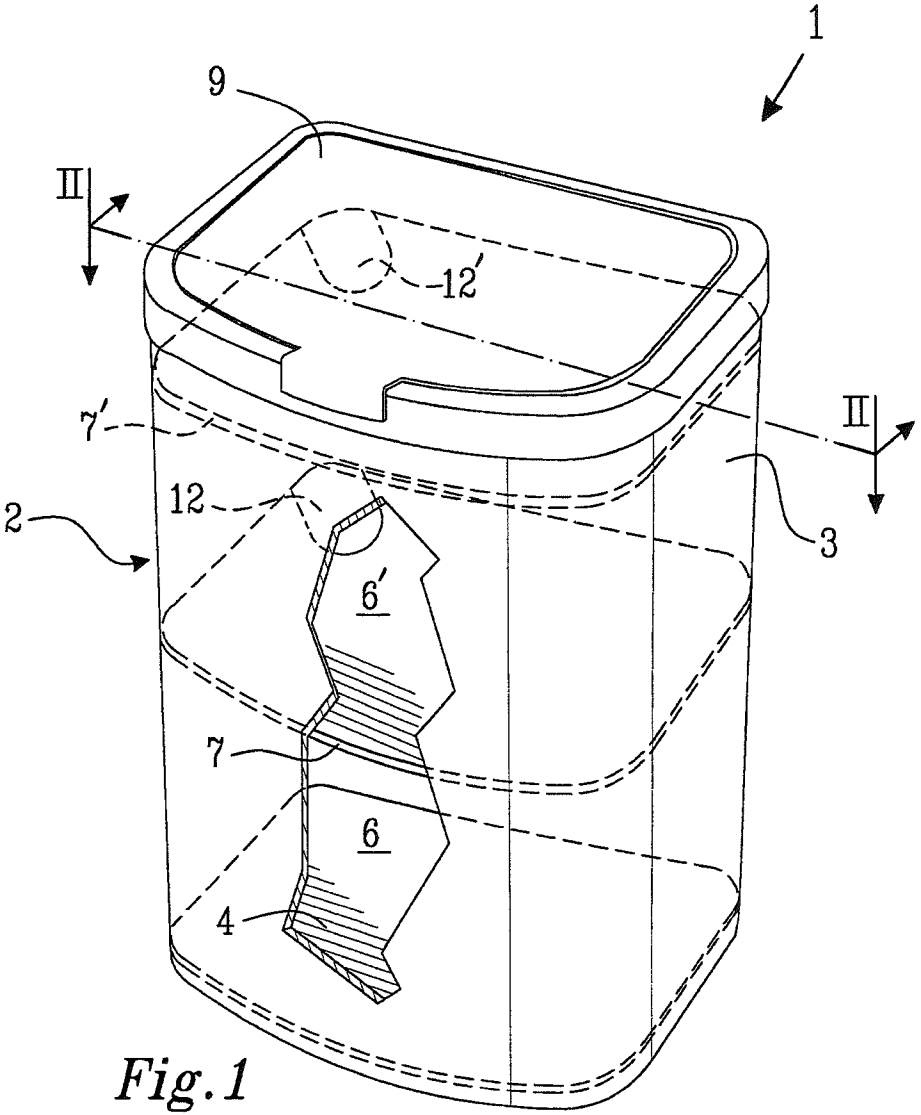
FIG. 1 illustrates a packaging container of the present invention.

FIGS. 1 and 2 show a packaging container 1 for pulverulent bulk solids according to the present invention. The packaging container 1 comprises a container body 2 having a container wall 3 extending from a container bottom 4 to a container opening 5 in a height direction of the container 1. The container wall 3 and the container bottom 4 delimit an inner space in the container, and a first peelable or tearable sealing membrane 7 which is attached to an inner surface of the container wall 3 forms a roof over a first inner compartment 6 in the inner space.

A second peelable or tearable sealing membrane 7' is applied between the first peelable or tearable sealing membrane 7 and an edge of the container opening 5 and is attached to the inner surface of the container wall 3. The first peelable or tearable sealing membrane 7 forms a floor of a second inner compartment 6' in the inner space of the container 1, while the second peelable or tearable sealing membrane 7' forms a roof over the second inner compartment 6'.

Both the first sealing membrane 7, and the second sealing membrane 7' is provided with a gripping member 12, 12' shown as a pull tab which is placed at a corner portion of each sealing membrane 7, 7'. The gripping member 12, 12' is arranged to facilitate removal of the peelable or tearable sealing membrane 7, 7' when accessing the compartment 6, 6' beneath the respective sealing membrane 7, 7'. As set out herein, the provision of a gripping member on the peelable or tearable sealing membranes in the packaging containers disclosed herein is a preferred but optional feature of the invention. The gripping member may take other forms than the pull tab illustrated in FIG. 1, such as a pull ring, a loop, a knob, etc. Furthermore, the gripping member may be formed integral with the sealing membrane or may be a separate component which has been attached to the sealing membrane. The placement of the gripping member may be different from that shown in FIG. 1. Accordingly the gripping member may be placed at another corner portion, and/or at a distance from the container wall. In a tearable sealing membrane, the gripping member may be arranged to initiate controlled tearing along a tear indication in the sealing membrane.

As shown in FIG. 2, the height of the first inner compartment, i.e. the distance $d_1$ between the container bottom 4 and the first sealing membrane 7 in the height direction of the packaging container 1 is slightly greater than the height of the second inner compartment 6', i.e. the distance $d_2$ between the first sealing membrane 7 and the second sealing membrane 7' in the height direction of the packaging container 1. As the container body 2 has the same cross-section all the way from the container bottom 4 to the container opening 5, the first inner compartment 6 is larger than the second inner compartment 6'.

The packaging container 1 according to the present invention thus keeps the bulk solids arranged in different inner compartments 6 and 6' separated from each other by the first sealing membrane 7. Therefore, the packaging container 1 has the advantage of providing a prolonged preserving of the bulk solids stored therein. The user will access the uppermost compartment, which in FIGS. 1 and 2 is the second inner compartment 6' by peeling or tearing the uppermost sealing membrane, which in FIGS. 1 and 2 is the second sealing membrane 7'. The first sealing membrane 7 may remain intact until the second inner compartment 6' has been completely emptied, thus protecting the contents of the first inner compartment 6 from exposure to the environment outside the first inner compartment 6 until a user decides to remove also the first sealing membrane 7.

Figure 3A:
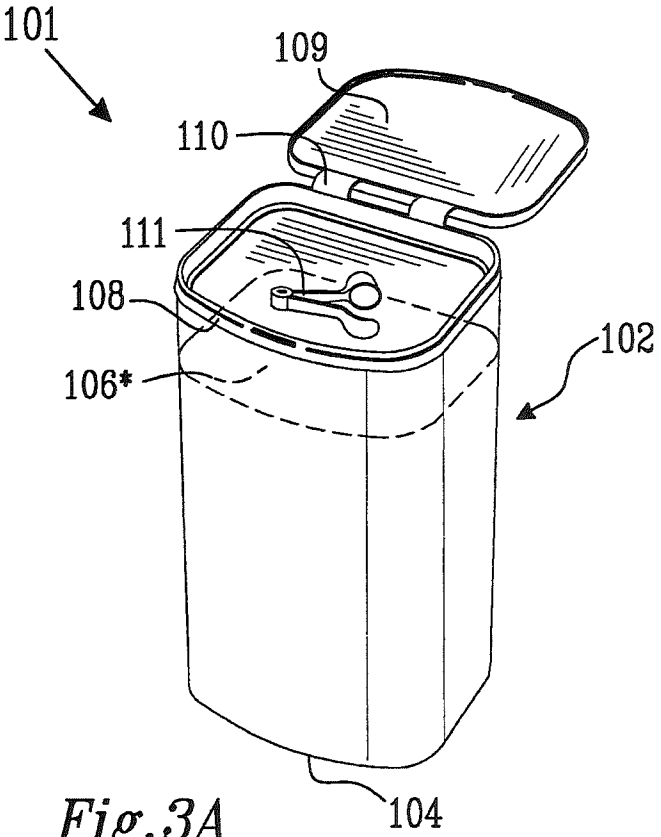
FIG. 3A illustrates an auxiliary device stored in the additional inner compartment.
Figure 3:
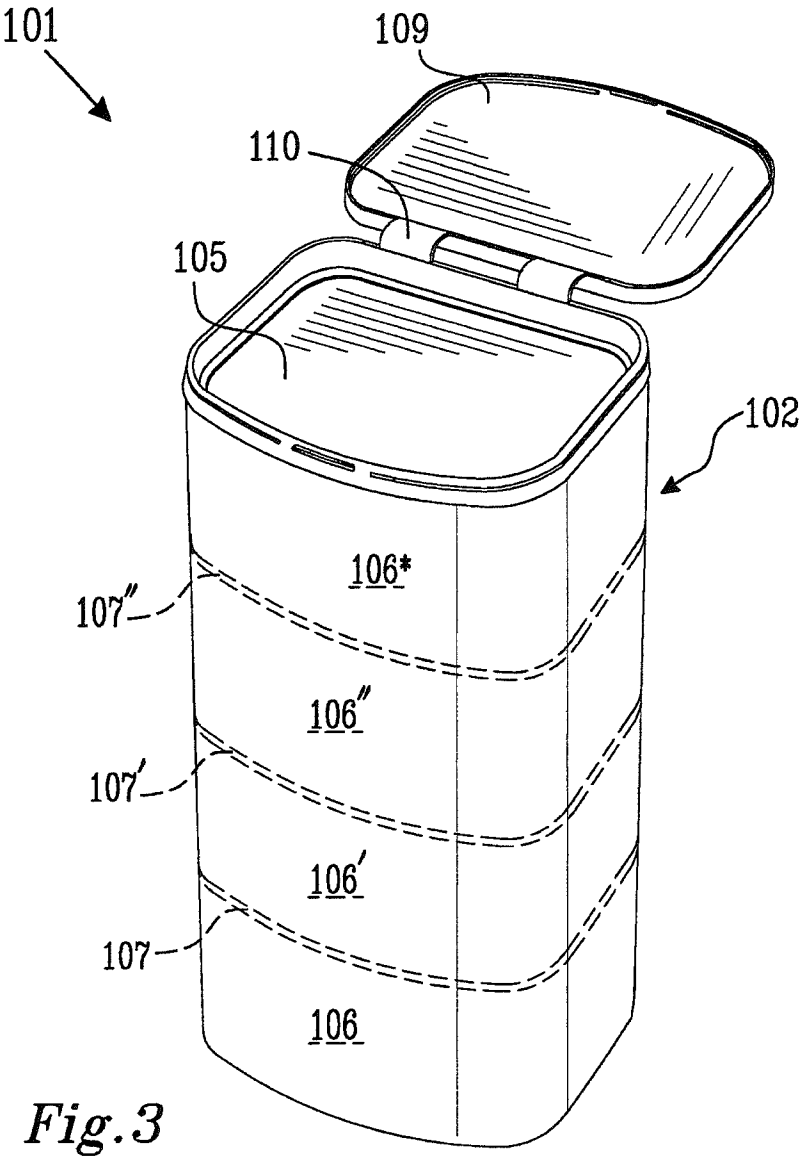
FIG. 3 depicts a perspective view of the packaging container of the present invention.

The packaging container 101 depicted in FIG. 3 comprises three sealing membranes 107, 107' and 107", thus forming three sealed inner compartments 106, 106' and 106". The uppermost peelable or tearable sealing membrane 107" which is the sealing membrane located closest to the container opening 105 forms a roof over a corresponding uppermost inner compartment 106" being located closest to the container opening 105. As shown in FIG. 3, the size of all the inner compartments 106, 106' and 106" in the packaging container 101 is the same. It is to be understood that equally sized compartments is not a necessary requirement of the invention and that differently sized compartments may be used instead, as disclosed herein.

Figure 4A:
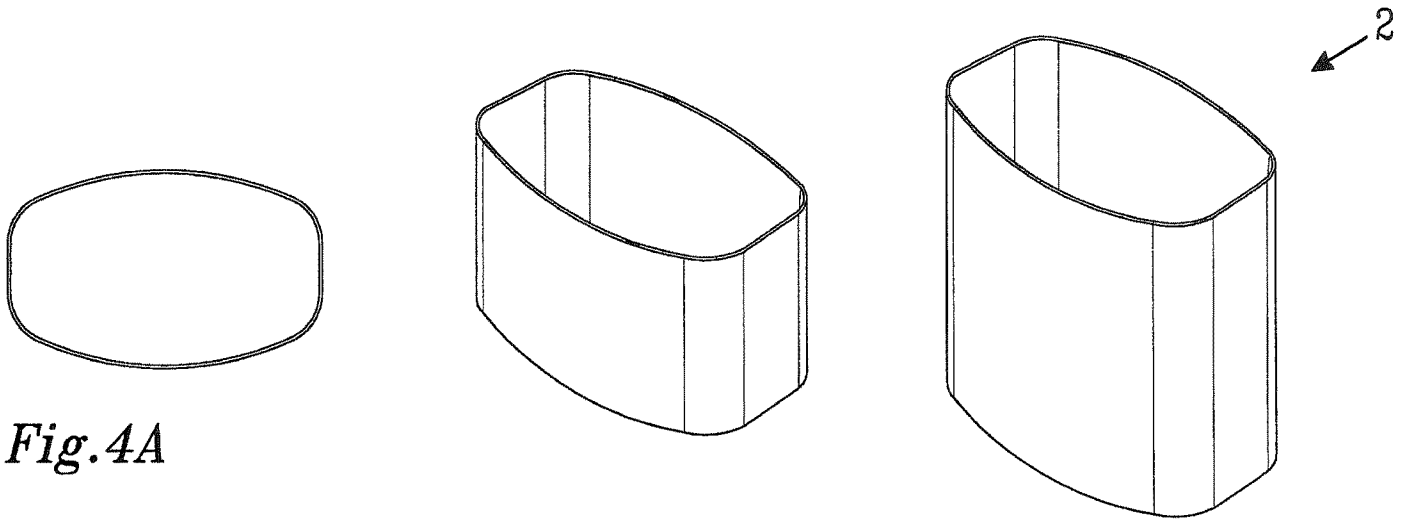
FIGS. 4A-4B show different shapes of the container body.
Figure 4B:
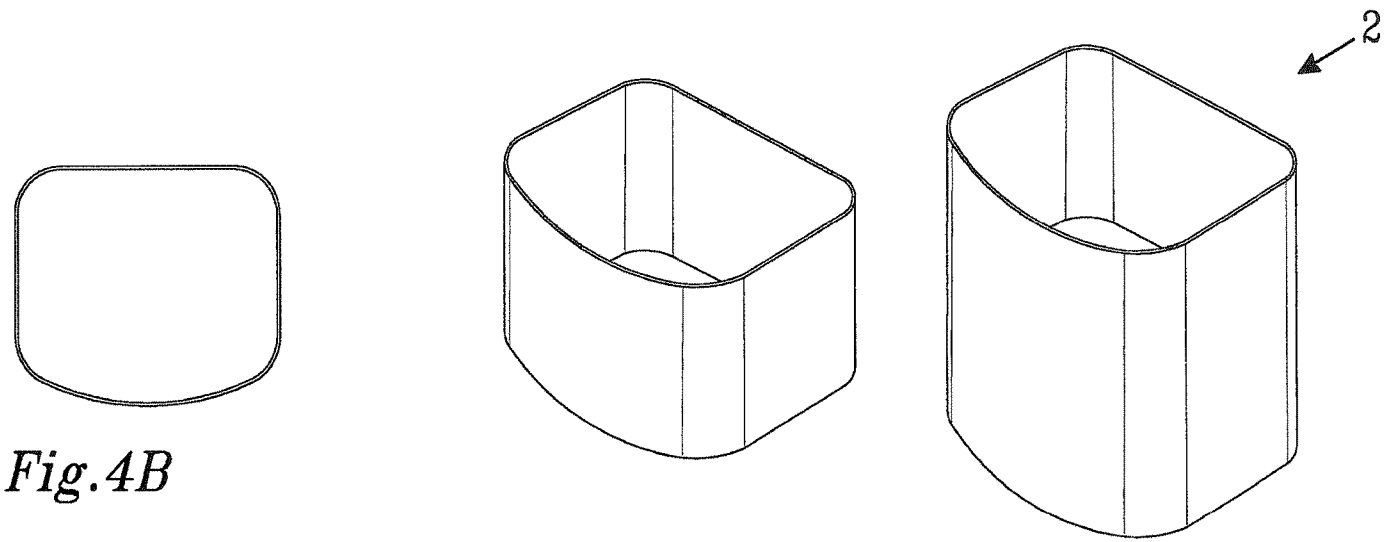

Furthermore, although the container body 2, 102 of the packaging containers 1, 101 in FIGS. 1 and 3 are shown to have a cuboid shape, any other shape suitable for the purpose may be used, as disclosed herein. Some examples of useful container body shapes are shown in FIGS. 4A and 4B.

Figure 5:
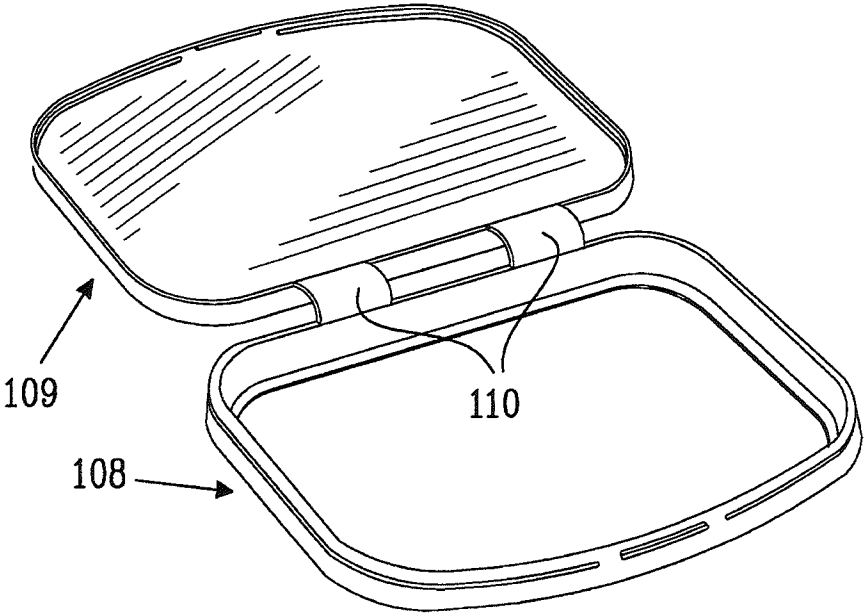
FIG. 5 depicts a lid and a rim to be used together with the packaging container according to the present invention.

A rim 108 such as a plastic rim or a metal rim may be applied to the edge of the container opening. A rim 108 is shown in FIG. 5, together with a hinged lid 109. The rim 108 is applied to the container opening 105 such that it extends around the full periphery of the container opening 105 and is affixed to the container body 102 along the opening edge. The container lid 109 is arranged to engage with the rim 108 or with the edge of the opening 105 to form a closure on the container 101. The closure between the container lid 109 and the rim 108 is accomplished by mating contours on the lid 109 and on the rim 108.

The container lid 109 is attached to the upper plastic rim 108 by means of a hinge 110. In the shown embodiment, the hinge 110 is a live hinge, i.e. a bendable connection between the lid 109 and the upper plastic rim 108. A live hinge 110 is formed integral with the lid 109 and the upper plastic rim 108. The live hinge may be substituted by a two-part hinge, as disclosed herein.

When the uppermost sealing membrane 107" is arranged at a distance from the container opening 105, as shown in FIG. 3, an additional inner compartment 106* is formed between the lid 109 on the container opening 105 and the uppermost sealing membrane 107". Thus, the floor of such an additional inner compartment 106* is formed by the uppermost sealing membrane 107", while the roof of the additional inner compartment 106* is formed by the lid 109. Such an additional compartment 106* may be used for containing an auxiliary device to be used with the bulk solids stored in the container, such as a dosing device 111 depicted in FIG. 3A.

FIGS. 4A-4B illustrate different shapes of the container body 2. In FIG. 4A, the front wall portion and the rear wall portion of the container body have an outwardly curved shape with a radius of curvature of 150 mm, while the side wall portions are substantially planar. The corner portions of the container body shown in FIG. 4A have a radius of curvature of 20 mm.

In FIG. 4B the container body having a generally D-shaped cross-section is depicted. The front wall portion has an outwardly curved shape with a radius of curvature of 120 mm, while the side wall portions and the rear wall portion are substantially planar. The corner portions adjacent to the front wall portion have a radius of curvature of 25 mm, while the other two corner portions have a radius of curvature of 20 mm. The advantages of a packaging container having a container body with a D-shaped cross-section have been mentioned above.

Although the present invention has been described with reference to various embodiments, those skilled in the art will recognise that changes may be made without departing from the scope of the invention. It is intended that the detailed description be regarded as illustrative and that the appended claims including all the equivalents are intended to define the scope of the invention.

The invention claimed is:

1. A method of making a packaging container for bulk solids, said method comprising:

assembling a container wall to a container bottom to form a container body, the container wall extending from the container bottom to a container opening in a height direction of said container, said container wall having wall portions and curved corner portions, said container wall and said container bottom delimiting an inner space in said container;

attaching a first sealing membrane to an inner surface of said container wall so as to form a roof over a first inner compartment in said inner space, said first sealing membrane being peelable or tearable via a gripping member of said first sealing membrane such that at least a portion of said first sealing membrane can be removed from said container body to provide access to said first inner compartment;

attaching a second sealing membrane to said inner surface of said container wall between said first sealing membrane and an edge of said container opening, said first sealing membrane forming a floor of a second inner compartment in said inner space and said second sealing membrane forming a roof over said second inner compartment, said second sealing membrane being peelable or tearable via a gripping member of said second sealing membrane such that at least a portion of said second sealing membrane can be removed from said container body to provide access to said second inner compartment; and affixing a rim and a lid to the container body such that the rim is affixed to said container body along said edge of said container opening and the lid is arranged to engage with said rim to form a closure on said packaging container.

2. The method according to claim 1, further comprising attaching one or more additional sealing membranes to said inner surface so as to divide said inner space into three or more inner compartments, said inner compartments being in addition to said first and second inner compartments being delimited in said height direction of said container by peelable or tearable sealing membranes, and wherein an uppermost one of the one or more additional sealing membranes is located closest to said container opening and forms a roof over a corresponding uppermost inner compartment located closest to said container opening.

3. The method according to claim 2, attaching said sealing membranes is performed such that a distance between said first and second sealing membranes in said height direction of said packaging container is different from a distance between the remaining sealing membranes, thus forming at least two differently sized inner compartments.

4. The method according to claim 1, wherein attaching said sealing membranes is performed such that they are arranged equidistantly from each other in said height direction of said packaging container, thus forming equally sized inner compartments.

5. The method according to claim 1, wherein the container bottom forms a floor of the first compartment and attaching said sealing membranes is performed such that a distance between said first and second sealing membranes in said height direction of said packaging container is different from the distance between the container bottom and first sealing membrane, thus forming differently sized first and second inner inner compartments.

6. The method according to claim 1, wherein the first and second peelable or tearable sealing membranes are peelable sealing membranes.

7. The method according to claim 1, wherein said container wall portions consist of a front wall portion, a rear wall portion and two side wall portions, said wall portions being connected at container body edge portions.

8. The method according to claim 1, wherein said curved corner portions have a radius of curvature of from 15 mm -100 mm.

9. The method according to claim 1, wherein said rim and said lid are formed together such that they are connected by an integral hinge.

10. The method according to claim 1, wherein said rim and said lid are formed separately and connected via a hinge.

11. The method according to claim 1, further comprising attaching a non-removable inner sealing membrane between the first and second peelable or tearable sealing membranes.

12. The method according to claim 1, further comprising packaging a first bulk solid within said first inner compartment, and a second bulk solid within said second inner compartment, the first bulk solid being different from the second bulk solid.

13. The method according to claim 1, further comprising packaging tobacco in said first and second inner compartments.

14. The method of claim 1, wherein attaching the first and second sealing membranes to the inner surface of the container wall includes gluing or welding the first and second sealing membranes to the inner surface of the container wall to form respective joints therebetween.

15. The method according to claim 1, wherein attaching the first sealing membrane to the inner surface of the container wall includes joining the first sealing membrane to the inner surface via a gastight seal.

16. The method of claim 15, wherein the first sealing membrane is a gastight membrane.

17. The method of claim 15, wherein attaching the second sealing membrane to the inner surface wall includes joining the second sealing membrane to the inner surface via a gastight seal.

18. The method of claim 17, wherein the second sealing membrane is a gastight membrane.

19. The method of claim 1, wherein the container body is made out of paperboard material.

20. The method of claim 19, wherein the first and second membranes are each made from aluminium foil, silicon-coated paper, plastic film, or laminates thereof.

* * * * *